US007591680B2

(12) United States Patent
Zhang et al.

(10) Patent No.: US 7,591,680 B2
(45) Date of Patent: Sep. 22, 2009

(54) CONDUCTIVE CAGE

(75) Inventors: Xin-Jie Zhang, Kunshan (CN); Chun-Hsiung Hsu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/286,599

(22) Filed: Sep. 30, 2008

(65) Prior Publication Data

US 2009/0124127 A1 May 14, 2009

(30) Foreign Application Priority Data

Nov. 9, 2007 (CN) ..... 200720042139

(51) Int. Cl.
*H01R 13/648* (2006.01)

(52) U.S. Cl. ..... 439/607.38; 439/939; 439/92; 439/609

(58) Field of Classification Search ..... 439/92, 439/95, 607.35, 607.37, 607.38, 609, 927, 439/939; 361/752, 756, 802
See application file for complete search history.

(56) References Cited

U.S. PATENT DOCUMENTS

| | | | | |
|---|---|---|---|---|
| 6,066,001 | A * | 5/2000 | Liptak et al. | 439/607 |
| 6,478,622 | B1 * | 11/2002 | Hwang | 439/607 |
| 6,655,995 | B1 * | 12/2003 | Reisinger et al. | 439/607 |
| 6,788,540 | B2 * | 9/2004 | Kruger et al. | 361/719 |
| 7,150,653 | B1 * | 12/2006 | Mason | 439/609 |
| 7,530,845 | B1 * | 5/2009 | Yang | 439/607.01 |
| 2003/0100204 | A1 * | 5/2003 | Hwang | 439/92 |
| 2007/0117458 | A1 | 5/2007 | Winker et al. | |
| 2008/0096429 | A1 * | 4/2008 | Mikolajczak et al. | 439/620.08 |
| 2009/0124127 | A1 * | 5/2009 | Zhang et al. | 439/607.38 |

* cited by examiner

*Primary Examiner*—James Harvey
(74) *Attorney, Agent, or Firm*—Wei Te Chung

(57) ABSTRACT

A conductive cage (100) for receiving a SFP transceiver includes a cage body (10) having a number of pins (122) extending downwardly and a unitary, rectangular-shaped collar (20) mounted onto the cage body. The unitary, rectangular-shaped collar has a top plate (21), a pair of opposite side plates (23) and a bottom plate (22). The bottom plate has a first bottom plate half (221) including a first engaging portion (24) and a second bottom plate half (222) having a corresponding second engaging portion (25) coupling with the first engaging portion for connecting the first bottom plate half to the second bottom plate half.

7 Claims, 5 Drawing Sheets

CONDUCTIVE CAGE

BACKGROUND OF THE INVENTION

1. Field of the Invention

The present invention relates to a conductive cage to avoid electromagnetic interference (EMI).

2. Description of the Prior Art

A small form-factor pluggable transceiver (SFP transceiver) provides a link between an electronic transmission line and an optical transmission line as a bi-direction optical-electronic converter. The SFP transceiver is mounted on a printed circuit board of a host system device via a high-speed connector. Then SFP transceiver and the connector are received in a conductive cage to avoid EMI.

U.S. Patent publication No. 2007/0117458 published on May 24, 2007 discloses an EMI-minimized transceiver received in a transceiver cage. The transceiver cage has a cage body and an outer shield. The cage body is of rectangular configuration and has a receiving space for receiving the EMI-minimized transceiver. The outer shield is rectangular and includes four side portions, an open corner defined between two adjacent side portions and a plurality of fingers extending from the side portions for contacting with a chassis. The outer shield is held on the cage body by spot welding the side portions to the cage body.

During assembly, the side portion is so small that it's difficult to spot weld the outer shield to the cage body. The reliability of the cage cannot be ensured.

Hence, an improved conductive cage is needed to solve the above problem.

BRIEF SUMMARY OF THE INVENTION

Object of the present invention is to provide a conductive cage having a unitary, rectangular-shaped collar easily mounted onto a cage body.

The present invention provides a conductive cage mounted on a printed circuit board for receiving a SFP transceiver comprising a cage body having a plurality of pins extending downwardly, and a unitary rectangular-shaped collar mounted onto the cage body. The unitary rectangular-shaped collar has a top plate, a pair of opposite side plates and a bottom plate. The bottom plate has a first bottom plate half including a first engaging portion and a second bottom plate half having a corresponding second engaging portion coupling with the first engaging portion for connecting the first bottom plate half to the second bottom plate half.

Advantages of the present invention are to provide a unitary, rectangular-shaped collar punched by a metal strip and having a bottom plate including a first bottom plate half and a second bottom plate half connecting to the first bottom plate half firmly. The rectangular-shaped collar is mounted to the cage body by an interference between the unitary, rectangular-shaped collar and the cage body to ease the assembly of the conductive cage.

Other objects, advantages and novel features of the invention will become more apparent from the following detailed description of the present embodiments when taken in conjunction with the accompanying drawings.

DETAILED DESCRIPTION OF THE INVENTION

Figure 1:
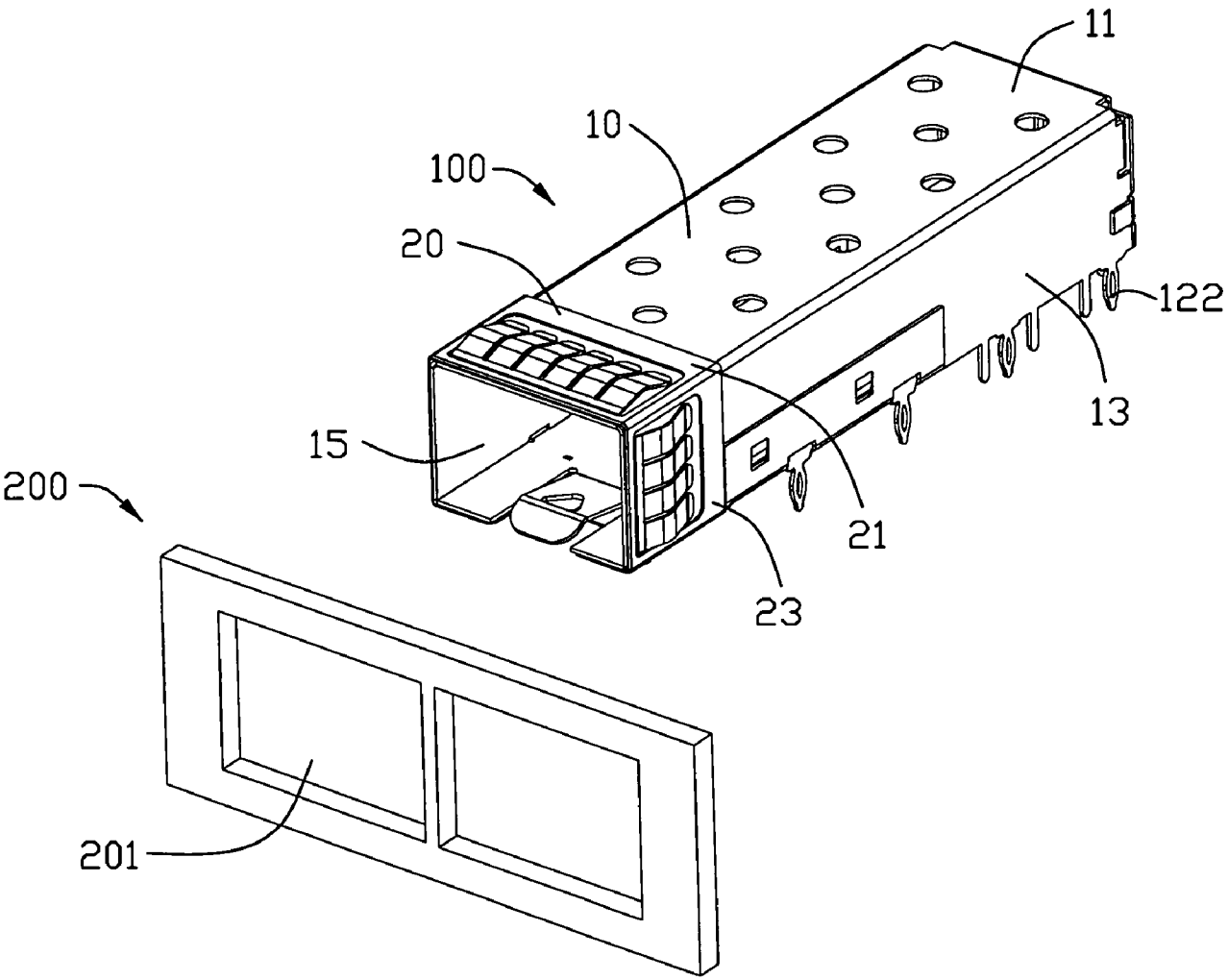
FIG. 1 is an assembled perspective view of a conductive cage and a chassis on which the conductive cage will be mounted.
Figure 2:
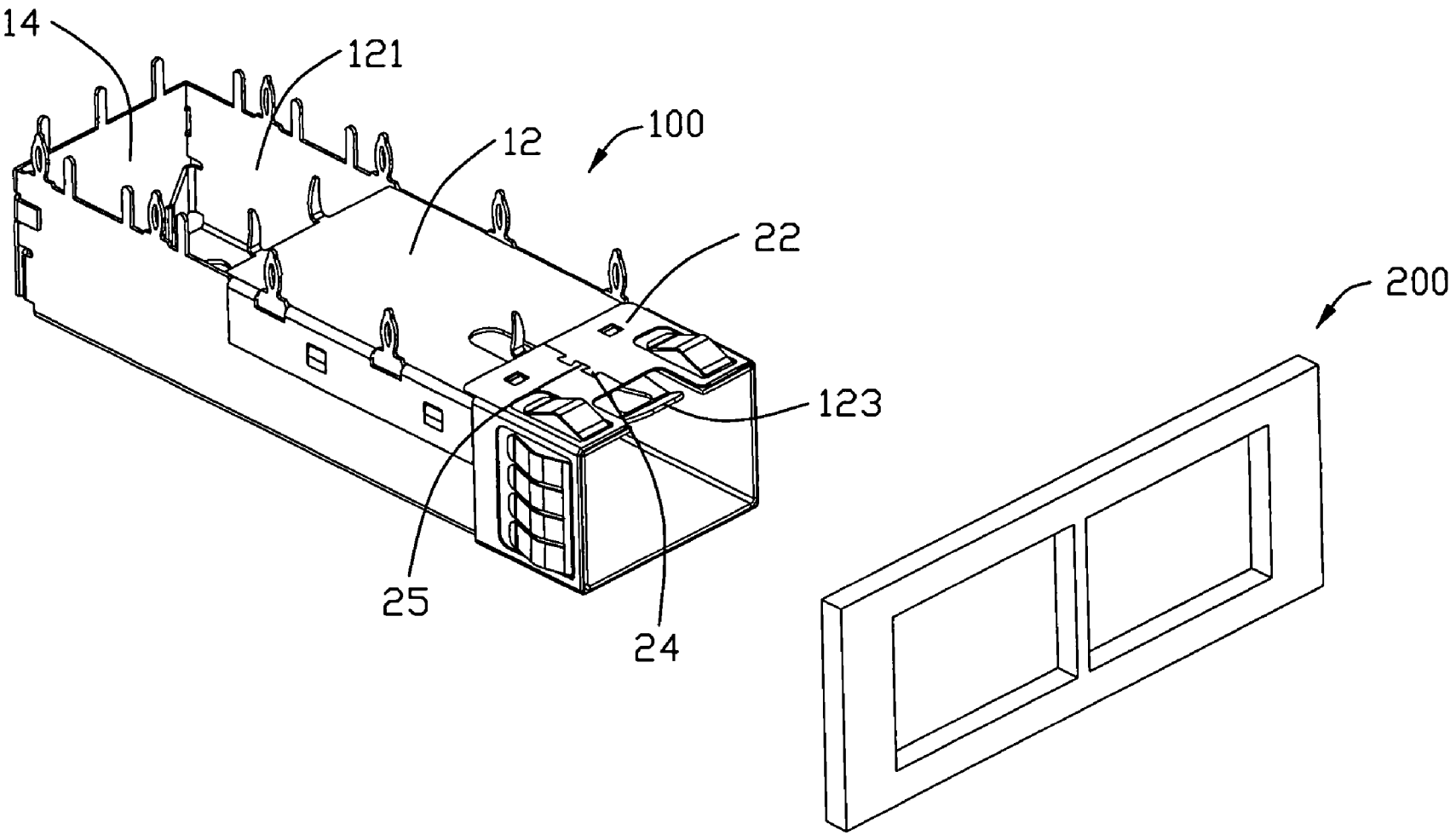
FIG. 2 is a view similar to FIG. 1 while taken from another aspect.
Figure 3:
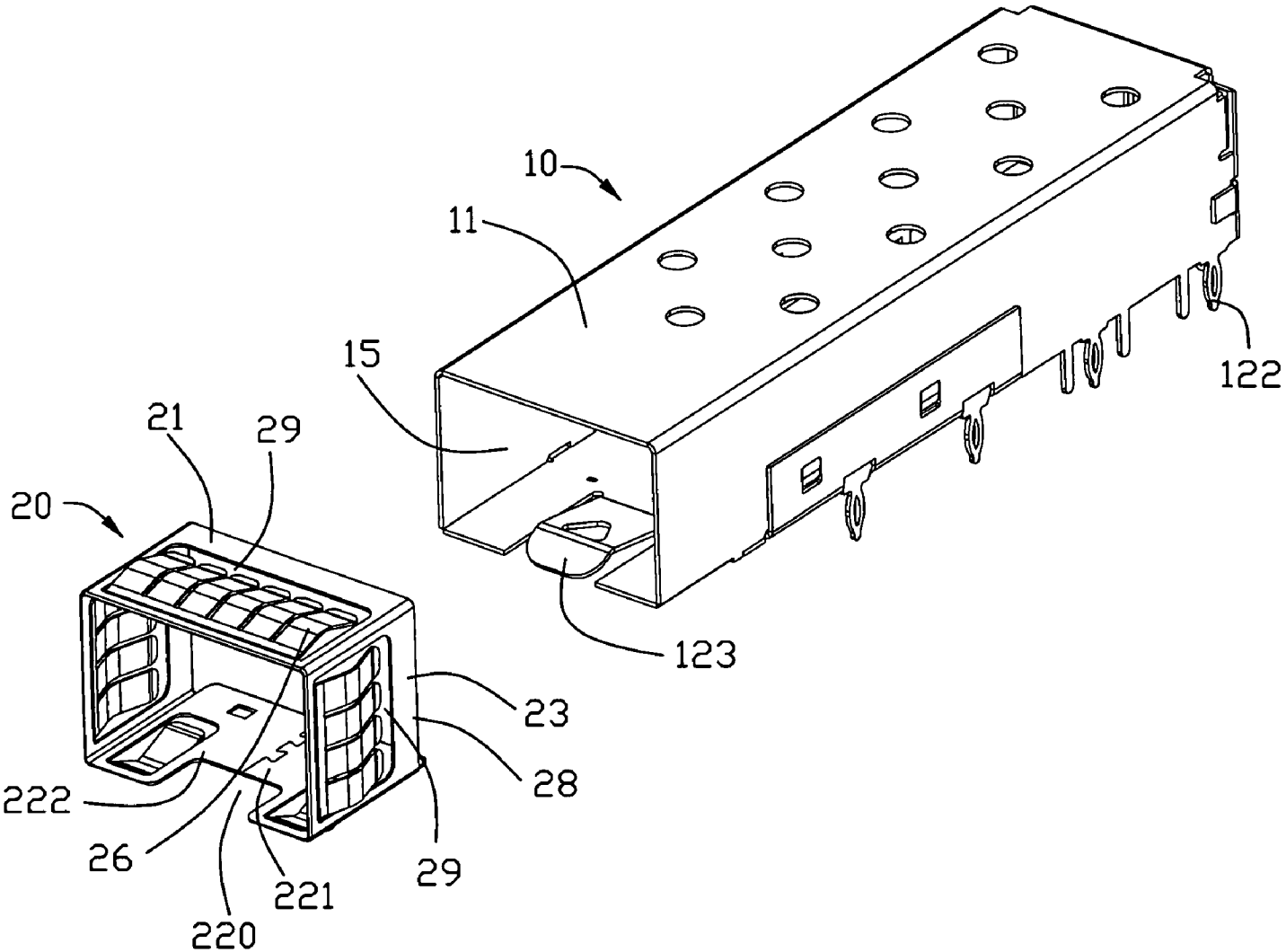
FIG. 3 is an exploded view of a conductive cage as shown in FIG. 1.
Figure 4:
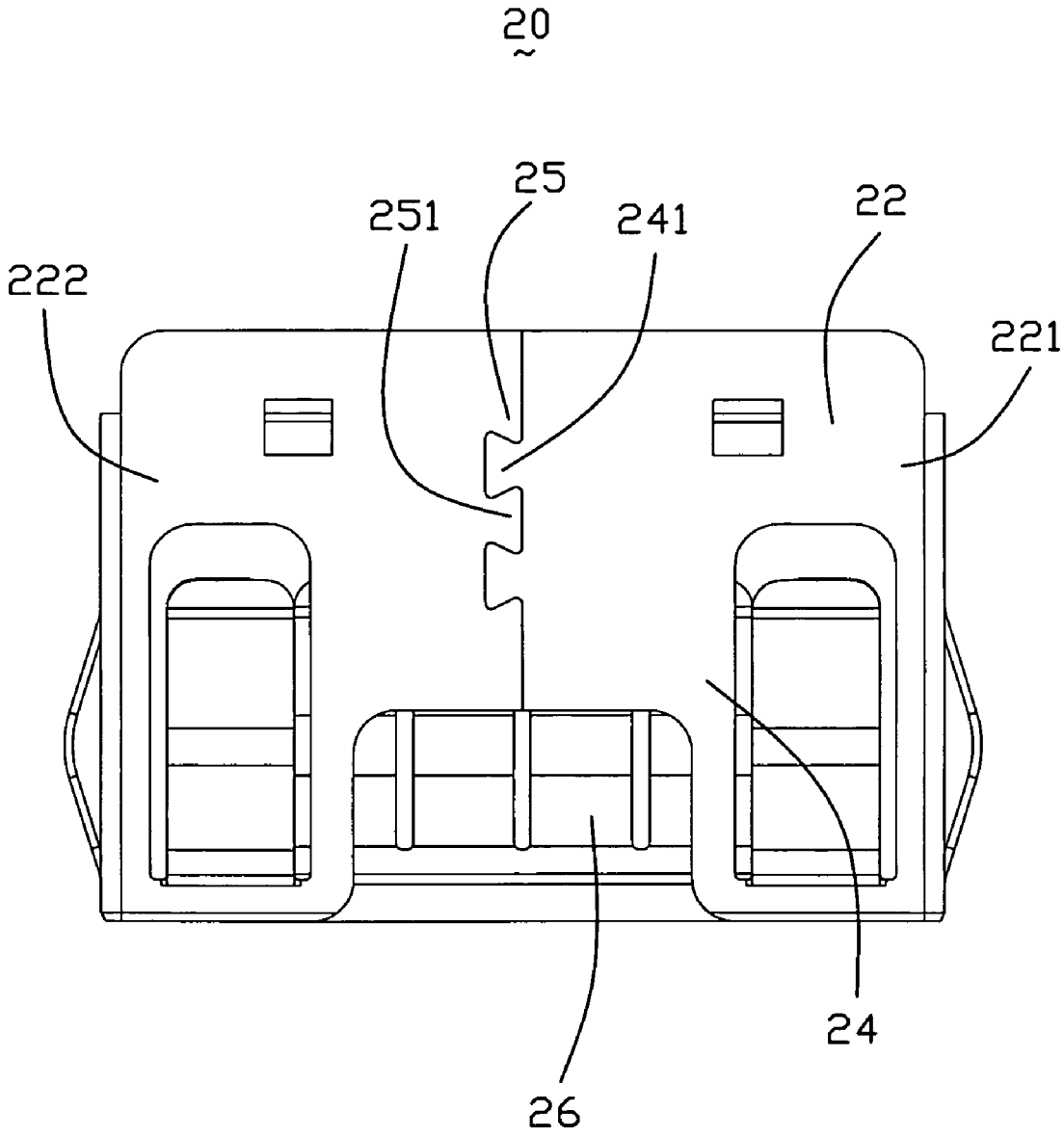
FIG. 4 is a bottom view of a cage body as shown in FIG. 3.
Figure 5:
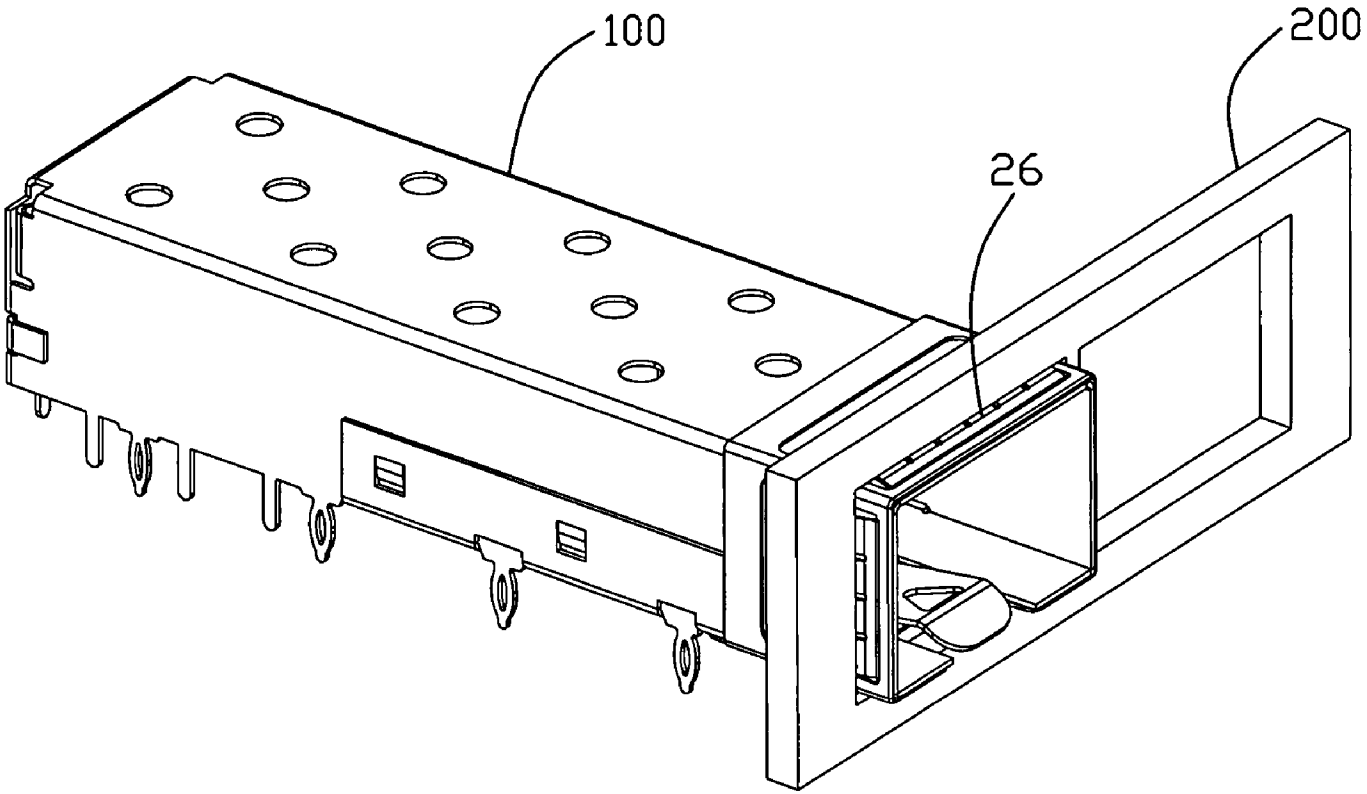
FIG. 5 is an assembled perspective view of the conductive cage mounted into the chassis.

Reference will now be made to the drawing figures to describe the present invention in detail. Referring to FIGS. 1-5, a conductive cage 100 mounted on a printed circuit board (not shown) for receiving an SFP transceiver (not shown) comprises a cage body 10 and a unitary, rectangular-shaped collar 20 mounted to the cage body 10.

The cage body 10 has a top wall 11, a bottom wall 12 in parallel with the top wall 11, a pair of side walls 13, a rear wall 14 and a receiving opening 15 defined therebetween for receiving the SFP transceiver. The bottom wall 12 has a plurality of pins 122 extending downwardly therefrom for connecting with the printed circuit board, a recess 121 defined thereon and communicated with the receiving opening 15 and a spring plate 123 extending upwardly from the bottom wall 12.

The unitary, rectangular-shaped collar 20 is punched by a metal strip and mounted onto the cage body 10. The unitary, rectangular-shaped collar 20 has a top plate 21, a pair of opposite side plates 23 and a bottom plate 22. The bottom plate 22 comprises a first bottom plate half 221 having a first engaging portion 24 and a second bottom plate half 222 having a corresponding second engaging portion 25 coupling with the first engaging portion 24 for connecting the first bottom plate half 221 to the second bottom plate half 222. The first engaging portion 24 is formed with a pair of first protrusions 241 and a first receiving recess (not labeled) defined between the pair of first protrusions 241. The second engaging portion 25 is formed with a second protrusion 251 received in said first receiving recess. In another embodiment, the first engaging portion 24 is welded to the second engaging portion 25. The bottom plate 22 further has a cutout 220 in communicating with the receiving opening 15 for coupling with the spring plate 123.

The top plate 21 and the pair of side plates 23 of the unitary, rectangular-shaped collar 20 respectively has a plurality of contact fingers 26, a base portion 28 and an opening 29 defined thereon. The contact fingers 26 rearwardly extend into the opening 29 and electrically contacting with a chassis 200 in which a conductive cage 20 is received.

During assembly, firstly, the first engaging portion 24 and the second engaging portion 25 are interconnected with each other by the interference between the second protrusion 251 and the two first protrusions 241. Secondly, the unitary, rectangular-shaped collar 20 is mounted to the cage body 10 firmly. Finally, the conductive cage 100 mounted into a passage 201 defined on the chassis 200.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A conductive cage mounted on a printed circuit board for receiving a small form-factor pluggable (SFP) transceiver, comprising:

a cage body having a plurality of pins extending downwardly;

said cage body has a top wall, a pair of side walls extending from outer edges of said top wall and a separate bottom wall piece having side plates mounted on said side walls;

said bottom wall has a spring plate extending upwardly from the bottom wall; and a unitary, rectangular-shaped collar mounted onto the cage body, said collar comprising a top plate, a pair of opposite side plates and a bottom plate, said bottom plate comprising a first bottom plate half having a first engaging portion and a second bottom plate half having a corresponding second engaging portion coupling with the first engaging portion for connecting the first bottom plate half to the second bottom plate half.

2. The conductive cage as claimed in claim 1, wherein said first engaging portion has a pair of first protrusions and a first receiving recess defined between the pair of first protrusions, and wherein the second engaging portion has a second protrusion interference fit in said first receiving recess.

3. The conductive cage as claimed in claim 1, wherein said bottom plate of the collar has a cutout defined on a front edge thereof.

4. The conductive cage as claimed in claim 1, wherein at least one of the plates of the collar has a base portion, an opening defined on the base portion and a plurality of contact fingers rearwardly extending within the opening.

5. The conductive cage as claimed in claim 1, wherein said cage body has four sides walls, a rear wall and a receiving opening defined therebetween for receiving the SFP transceiver.

6. The conductive cage as claimed in claim 5, wherein the bottom side wall has a recess communicating with the receiving opening.

7. The conductive cage as claimed in claim 1, wherein said collar is punched and formed by a resilient thin metal strip and firmly mounted to the cage body with an interference fit between the collar and the cage body, and the first engaging portion and the second engaging portion are interlocked with each other.

* * * * *